US011719058B2

(12) United States Patent
Quero

(10) Patent No.: US 11,719,058 B2
(45) Date of Patent: Aug. 8, 2023

(54) SYSTEM AND METHOD TO CONDUCT UNDERBALANCED DRILLING

(71) Applicant: HALLIBURTON ENERGY SERVICES, INC., Houston, TX (US)

(72) Inventor: Philippe Quero, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 258 days.

(21) Appl. No.: 17/124,206

(22) Filed: Dec. 16, 2020

(65) Prior Publication Data

US 2022/0186574 A1 Jun. 16, 2022

(51) Int. Cl.
*E21B 21/08* (2006.01)
*E21B 34/08* (2006.01)
*E21B 47/24* (2012.01)

(52) U.S. Cl.
CPC ..... *E21B 21/085* (2020.05); *E21B 34/08* (2013.01); *E21B 47/24* (2020.05)

(58) Field of Classification Search
CPC ..... E21B 21/00; E21B 21/08; E21B 21/085; E21B 34/08
See application file for complete search history.

(56) References Cited

U.S. PATENT DOCUMENTS 8,100,199 B2 * 1/2012 Braddick ..... E21B 21/106 175/218
9,416,599 B2 * 8/2016 Bailey ..... E21B 17/18
2006/0254822 A1 * 11/2006 Ayling ..... E21B 19/165 175/218
2009/0025930 A1 * 1/2009 Iblings ..... E21B 21/12 166/54
2011/0308860 A1 * 12/2011 deBoer ..... E21B 17/00 175/218

(Continued)

FOREIGN PATENT DOCUMENTS

JP 2016528410 A 9/2016
WO 2006138565 A1 12/2006
WO WO-2018136571 A1 * 7/2018 ..... E21B 19/161

OTHER PUBLICATIONS

International Search Report and Written Opinion for International application No. PCT/US2020/065623, dated Sep. 1, 2021, 14 pages.

*Primary Examiner* — Matthew R Buck
(74) *Attorney, Agent, or Firm* — Polsinelli PC

(57) ABSTRACT

An underbalanced drilling system is provided. A bottomhole assembly includes a drill bit drilling a wellbore in a formation underbalanced. The bottomhole assembly includes a telemetry sub. A telemetry component transmits signals in real-time between the telemetry sub of the bottomhole assembly and a controller on the surface. A drill string is coupled with the bottomhole assembly, and the drill string includes a plurality of drill collars. The drill collars form a channel through which drilling fluid flows from the surface to the bottomhole assembly. The drill string is inserted into the wellbore by a hydraulic work over unit. A continuous circulation component provides continuous circulation of the drilling fluid while a new drill collar is coupled to the drill string. The continuous circulation component substantially maintains a wellbore density at a predetermined density.

20 Claims, 7 Drawing Sheets

(56) References Cited

U.S. PATENT DOCUMENTS

| | | | | |
|---|---|---|---|---|
| 2016/0084077 | A1* | 3/2016 | Lehr | E21B 21/103<br>367/83 |
| 2017/0183926 | A1 | 6/2017 | Bernard | |
| 2018/0202247 | A1* | 7/2018 | Johnson | E21B 21/106 |
| 2020/0056432 | A1 | 2/2020 | Dow et al. | |

* cited by examiner

SYSTEM AND METHOD TO CONDUCT UNDERBALANCED DRILLING

FIELD

The present disclosure relates generally to systems and methods to conduct underbalanced drilling. In some embodiments, the present disclosure relates to systems and methods to conduct underbalanced drilling with a hydraulic work over unit.

BACKGROUND

In order to produce oil or gas, a well is drilled into a subterranean formation, which may contain a hydrocarbon reservoir or may be adjacent to a reservoir. Many drilling components may be utilized to drill a well such as drill collars, drill bits, and downhole tools. During drilling, drilling fluid may be used to return cuttings and/or wellbore fluid back to the surface.

BRIEF DESCRIPTION OF THE DRAWINGS

Implementations of the present technology will now be described, by way of example only, with reference to the attached figures, wherein.

DETAILED DESCRIPTION

Figure 1A:
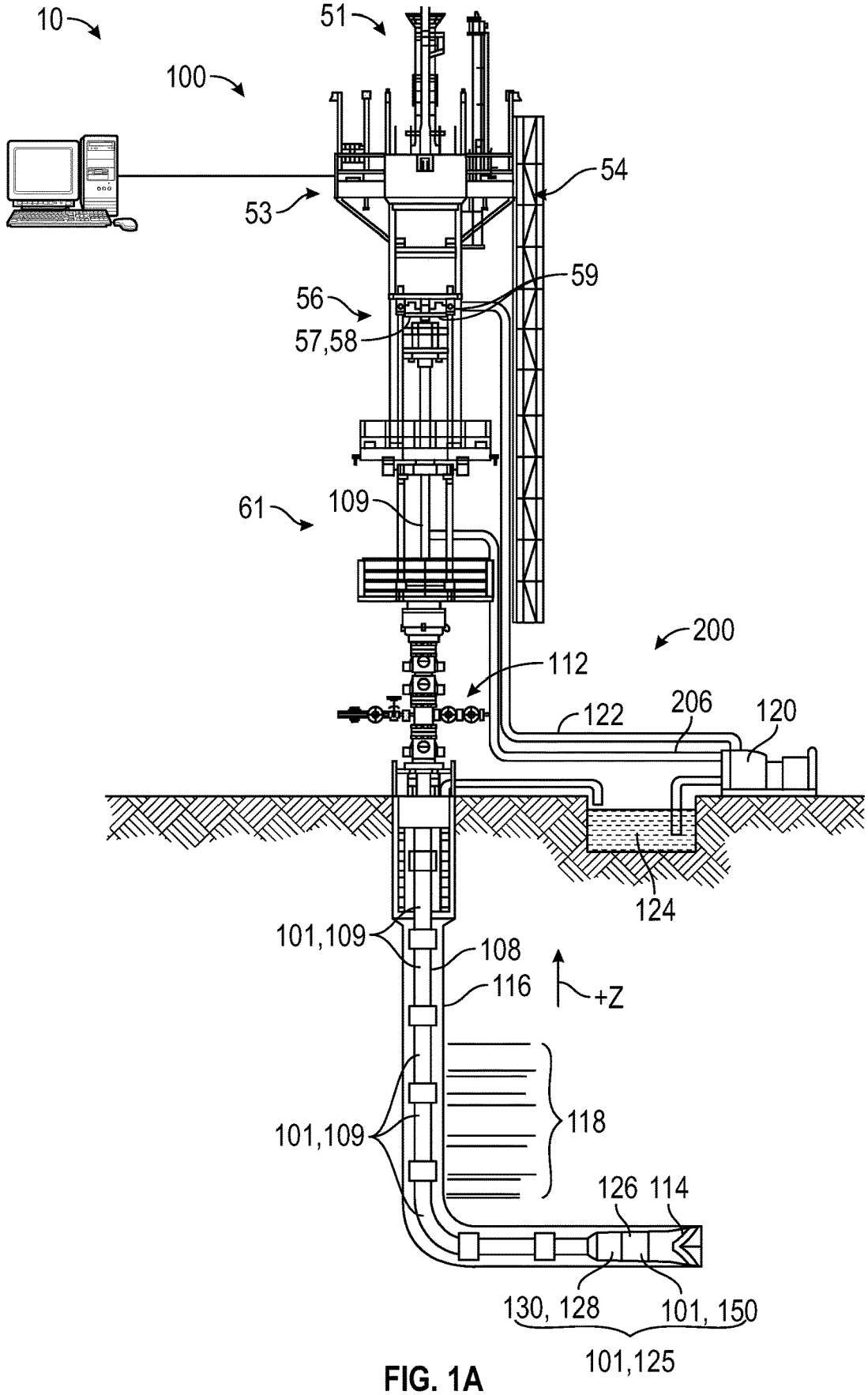
FIG. 1A is a diagram illustrating an example of an environment with a stand alone hydraulic work over unit in which a drilling system may be used in accordance with the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Disclosed herein is a drilling system to drill a wellbore underbalanced utilizing a drill string with a plurality of drill collars. The drilling system can be utilized, for example, for carbonated reservoirs with natural fractures. By drilling underbalanced, the drilling fluid does not enter the natural fractures, and the fluid exits the formation and flows into the wellbore by following the pressure differential. As the drilling fluid is not entering the natural fractures, the reservoir may not be damaged, leakoffs or cuttings from the drilling may not enter the natural fractures, the natural fractures may not be sealed off, and subsequently there may not be a need to clean the well for example with acid. A precise backpressure is maintained at the surface so that the well does not kick and collapse the openhole which can trap the bottomhole assembly. Additionally, a balance is maintained between (1) the amount of fluid to activate a drill bit of the bottomhole assembly to drill the wellbore and to carry the cuttings, and (2) the amount of fluid to control the amount of gas and/or liquid the formation is contributing. For example, gas, such as nitrogen, may be injected into the drilling fluid if the well is only contributing liquid.

The drill string includes a plurality of drill collars so that the drill string can be utilized to drill long laterals and a wellbore with wide diameter. The hydraulic work over unit can manipulate, rotate, and steer the drill string while pushing the drill string into the wellbore. In underbalanced drilling, the density of the wellbore must be maintained. A continuous circulation component is included to continuously supply drilling fluid into the wellbore while an upper supply conduit is disconnected to couple a new drill collar to the drill string. Accordingly, the present drilling system prevents moments where the drilling fluid is no longer circulating in the wellbore which can change parameters of the wellbore.

The underbalanced drilling system also includes a telemetry component to transmit signals in real-time between a telemetry sub of the bottomhole assembly and a controller on the surface. With such real-time data, the delicate balance of wellbore parameters can be maintained during underbalanced drilling.

Figure 1B:
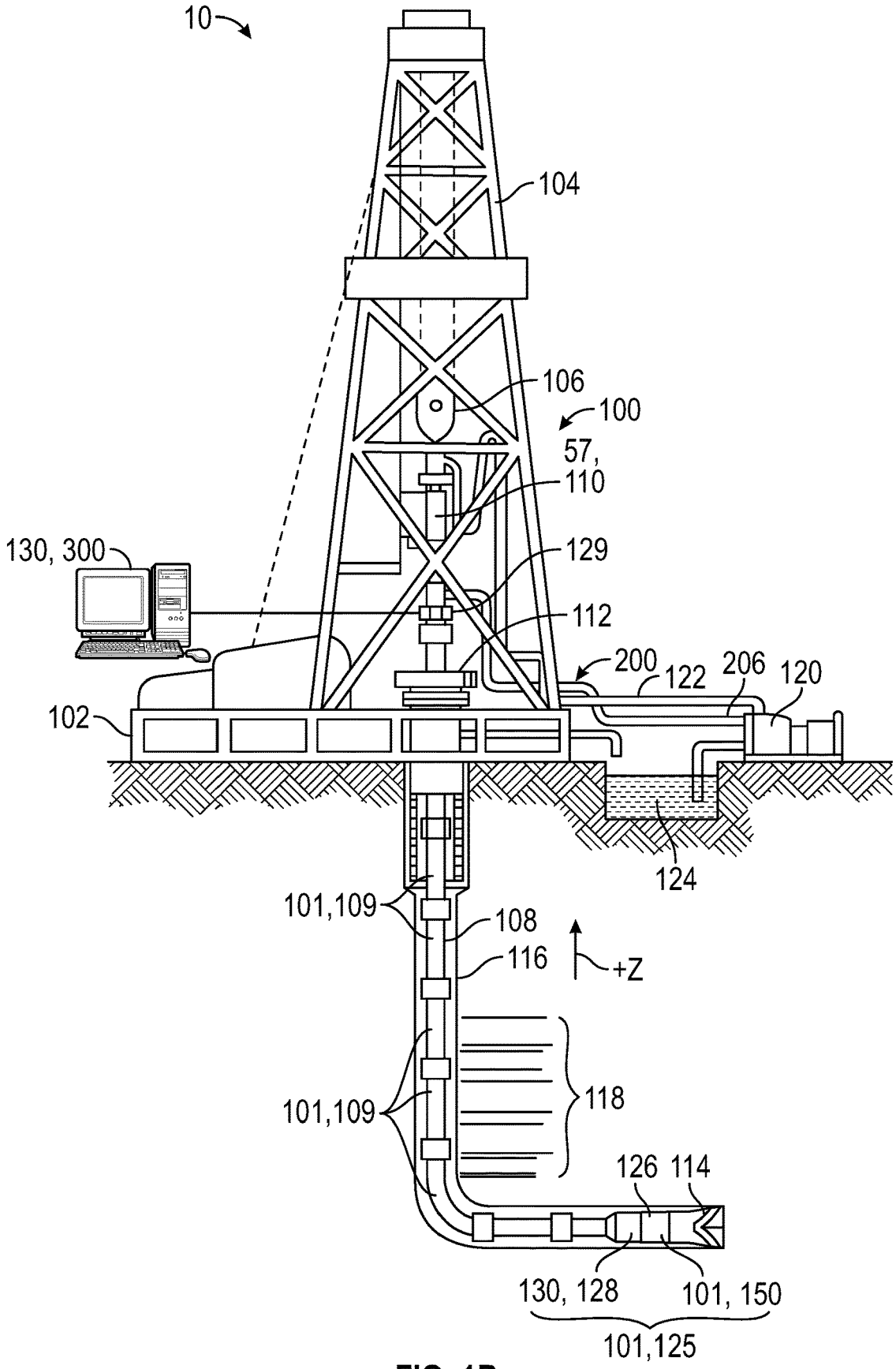
FIG. 1B is a diagram illustrating an example of an environment in which a drilling system may be used in accordance with the present disclosure.

The disclosure now turns to FIGS. 1A and 1B, which illustrate diagrammatic views of exemplary wellbore underbalanced drilling environments 10, for example a logging while drilling (LWD) and/or measurement while drilling (MWD) wellbore environment, in which the present disclosure may be implemented. During underbalanced drilling, the pressure in the wellbore 116 is maintained at a pressure lower than the static pressure of the formation 118 being drilled. Accordingly, the wellbore fluid follows the pressure differential and flows from the formation 118 into the wellbore 116 and up to the surface. A balance is reached between having enough drilling fluid to activate a drill bit 114 and carry cuttings and controlling the amount of gas and/or liquid the formation 118 is contributing. A precise backpressure at the surface must be maintained to prevent the well from kicking and/or collapsing. As no hydrostatic column is present to control the well as in overbalanced drilling, leakoff or cuttings inside the fractures can be avoided.

FIG. 1A illustrates a standalone hydraulic work over unit 100 for raising and lowering one or more drilling components 101 into a wellbore 116. The hydraulic work over unit 100 can include a gin pole 51 which can be mounted at the back of a workbasket 53. The gin pole 51 can be used in conjunction with a counterbalance winch and laydown winch (not shown) to raise and lower one or more drilling components 101 to and/or from the workbasket 53. The gin pole 51 can be a telescopic structure that can be shipped out in its retracted form prior to installation and erected at the worksite. The gin pole 51 may have a load capacity, for example, from about 2000 pounds to about 8000 pounds.

The workbasket 53 can serve as an attachment structure for one or more of the following components: a pipe handling winch, a gin pole 51, a tong, personnel escape poles, railing for personnel protection, and/or a ladder 54. In some embodiments, the workbasket 53 may also include a controller 300 which may include a telemetry component 130, an operator console and/or blowout preventer console. In other examples, the controller 300 may be disposed in other locations so long as the controller 300 can send and receive signals with the drilling system.

A jack assembly 56 can lower the drilling components 101 into the wellbore 116. The jack assembly 56 can include one or more hydraulic jacks 59. The hydraulic jacks 59 can include cylinders, for example 2 to 4 cylinders, with a stroke, for example about 10 feet.

The jack assembly 56 can include an insertion component 57 operable to rotate and lower the drilling components 101 into the wellbore 116. In some embodiments, such shown as in FIG. 1A, the insertion component 57 can include a rotary table 58. The rotary table 58 can provide rotational force to the drill string 108 to facilitate the process of drilling a wellbore 116. In some examples, the rotary table 58 can provide a force from about 3000 ft.lbs to about 23000 ft.lbs. The insertion component 57 can also include hydraulic actuated slips to handle the drilling components 101. Traveling slips, situated on the traveling head, can be fixed on top of the cylinders and stroke the hydraulic jacks 59. Stationary slips can be situated on the bottom plate of the jack assembly 56 and/or below the jack assembly 56.

In some embodiments, the jack assembly 56 can insert and lower the drilling components 101 into the wellbore 116 through a wellhead 112. The wellhead 112 can include, for example, a blowout preventer and/or a stripper. The stripper can provide a pressure seal around the drill string 108 as the drill string 108 is being run into and/or pulled out of the wellbore 116. The blowout preventer can seal, control, and/or monitor the wellbore 116 to prevent blowouts, or uncontrolled and/or undesired release of fluids from the wellbore 116. In other examples, different systems can be utilized based on the type of drill string 108 and/or the environment such as subsea or surface operations.

In some embodiments, an access window 61 provides visual access to the wellbore below the hydraulic jack 59 and slips. The access window 61 may be utilized where a bit (or packer) larger than the bore of the jack was to be installed into the drill string 108. In some examples, the access window 61 may be utilized in operations involving the strapping on of electrical cable for ESP's or control line to the outside of a drill string 108 being installed in a wellbore 116. The access window 61 may include removable pipe guides which can support the drill string 108 to prevent buckling.

FIG. 1B illustrates a drilling platform 102 equipped with a derrick 104 that supports a hydraulic work over unit 100 for raising and lowering one or more drilling components 101 into a wellbore 116. For example, the drilling components 101 can be raised and lowered by a hoist 106. The one or more drilling components 101 can include, for example, a drill string 108 which can include one or more drill collars 109, a drill bit 114, and/or a bottom-hole assembly 125. The drilling components 101 are operable to drill the wellbore 116.

As illustrated in FIG. 1B, the hoist 106 can suspend an insertion component 57 suitable for rotating the drill string 108 and lowering the drill string 108 through the well head 112. In some embodiments, such as shown in FIG. 1B, the insertion component 57 can include a top drive 110. The wellhead 112 can include, for example, a blowout preventer and/or a stripper. The stripper can provide a pressure seal around the drill string 108 as the drill string 108 is being run into and/or pulled out of the wellbore 116. The blowout preventer can seal, control, and/or monitor the wellbore 116 to prevent blowouts, or uncontrolled and/or undesired release of fluids from the wellbore 116. In other examples, different systems can be utilized based on the type of drill string 108 and/or the environment such as subsea or surface operations.

It should be noted that while FIGS. 1A and 1B generally depict a land-based operation, the principles described herein are equally applicable to operations that employ floating or sea-based platforms and rigs, without departing from the scope of the disclosure. Also, even though FIGS. 1A and 1B depict an L-shaped wellbore 116, the present disclosure is equally well-suited for use in wellbores having other orientations, including horizontal wellbores, slanted wellbores, multilateral wellbores or the like. By utilizing a drill string 108 with drill collars 109 and a hydraulic work over unit 100, the hydraulic work over unit 100 can manipulate and/or steer the drill string 108 to better accommodate long laterals in the wellbore 116. Additionally, the drill string 108 with drill collars 109 can provide a broader range of diameters than, for example, coiled tubing.

As illustrated in FIGS. 1A and 1B, connected to the lower end of the drill string 108 is a drill bit 114. As the drill bit 114 rotates, the drill bit 114 creates a wellbore 116 that passes through various formations 118. A pump 120 circulates drilling fluid through an upper supply conduit 122 to insertion component 57, such as rotary table 58 and/or top drive 110, down through the interior of drill string 108, through orifices in drill bit 114, back to the surface via the annulus around drill string 108, and into a retention pit 124. The drilling fluid transports cuttings from the wellbore 116 into the pit 124 and aids in maintaining the integrity of the wellbore 116. For underbalanced drilling, the drilling fluid does not enter the natural fractures in the formation 118, and the natural fractures in the formation 118 are not damaged or clogged. Accordingly, the wellbore fluid from the formation 118 naturally flows out of the formation 118 into the wellbore 116, and the drilling fluid carries the wellbore fluid to the surface. Various materials can be used for drilling fluid for underbalanced drilling, including water-based fluids or gel-based fluids. In some examples, gas can be injected into the drilling fluid to reduce its equivalent density and subsequently the hydrostatic pressure throughout the wellbore 116. The gas can be, for example, nitrogen, air, reduced oxygen air, processed flue gas, natural gas, or any other suitable gas.

Figure 2A:
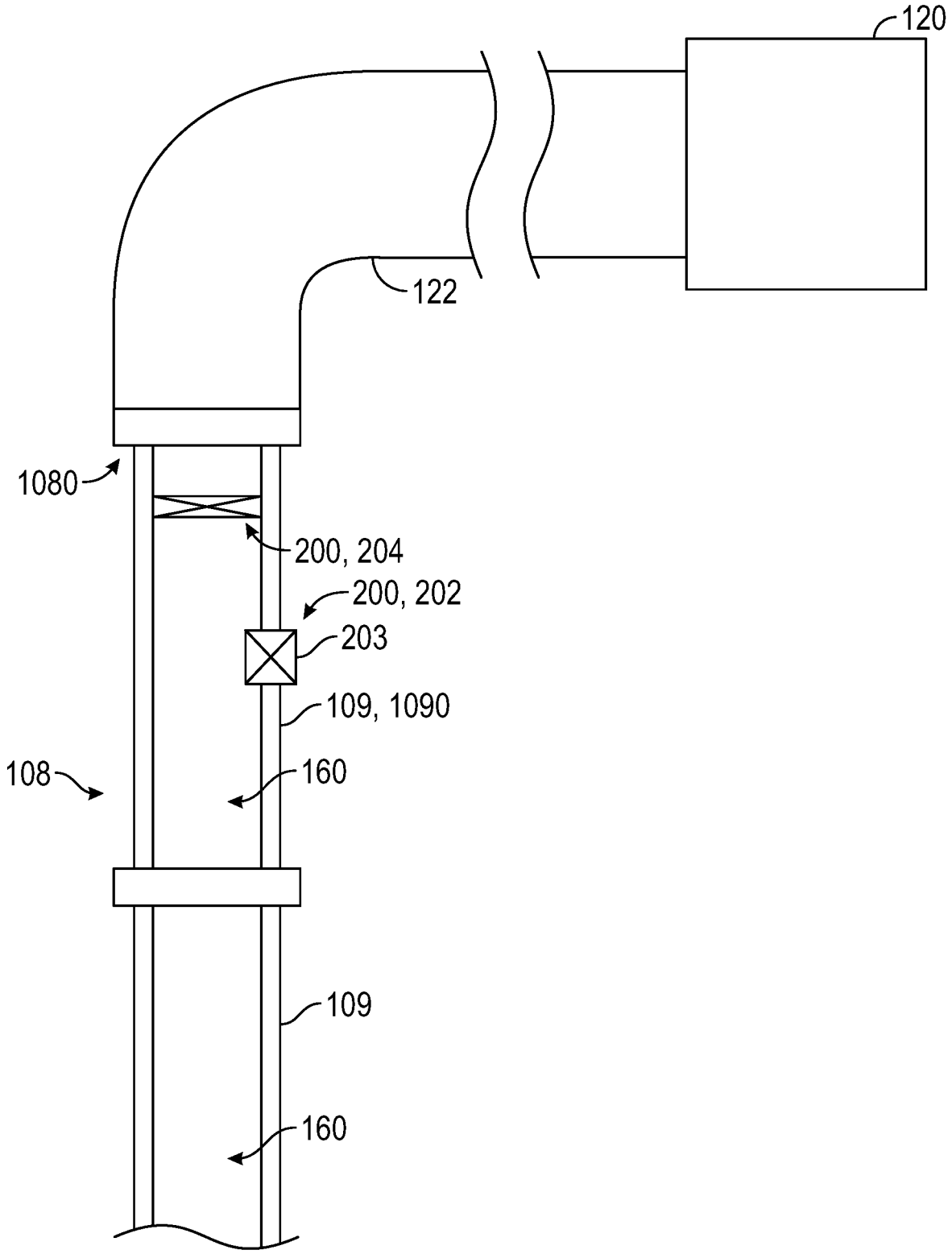
FIG. 2A is a diagram illustrating an example of a portion of a hydraulic work over unit with a continuous circulation component.
Figure 2B:
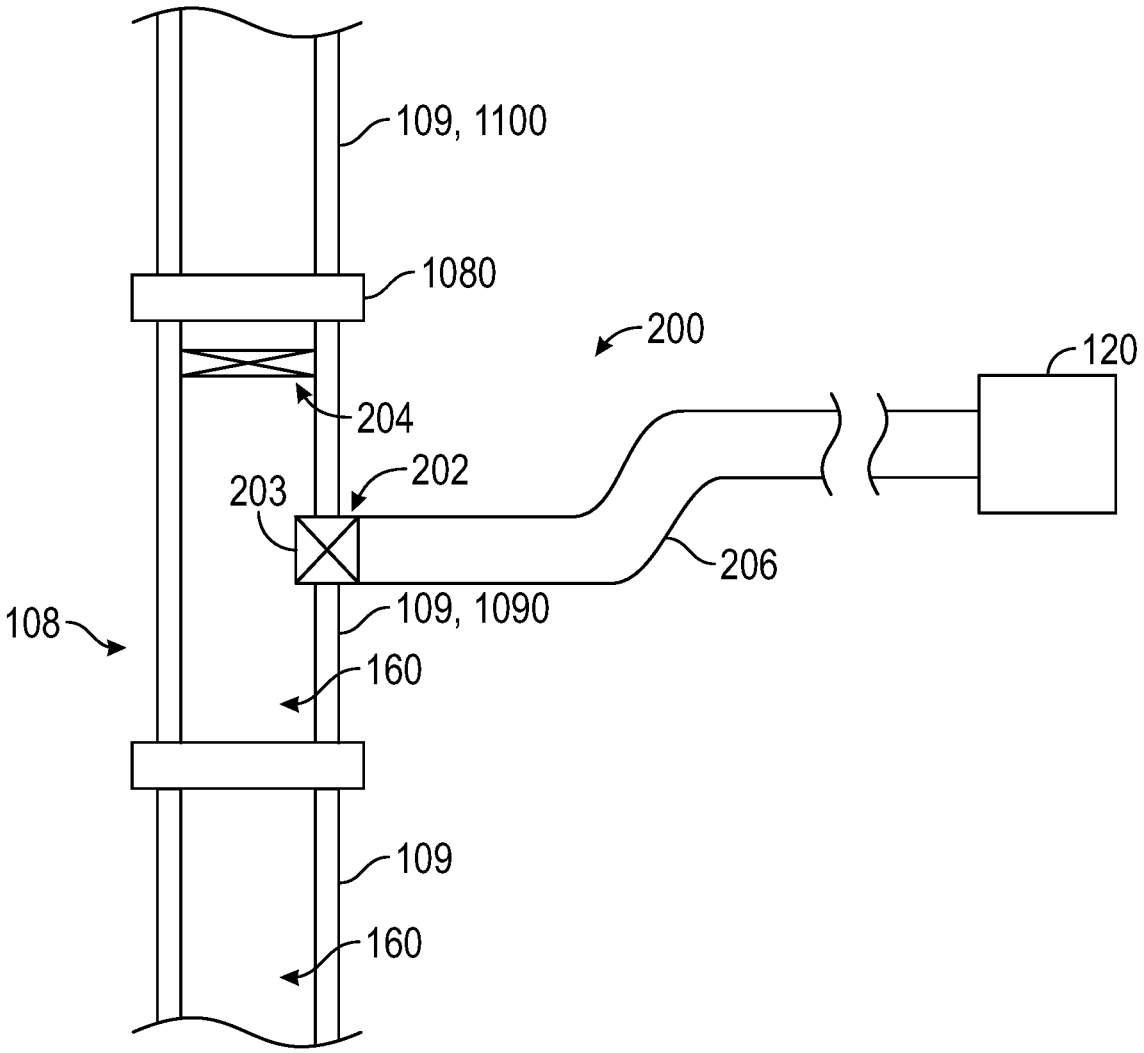
FIG. 2B is a diagram illustrating the continuous circulation component of FIG. 2A with drilling fluid being pumped through a side port.
Figure 2C:
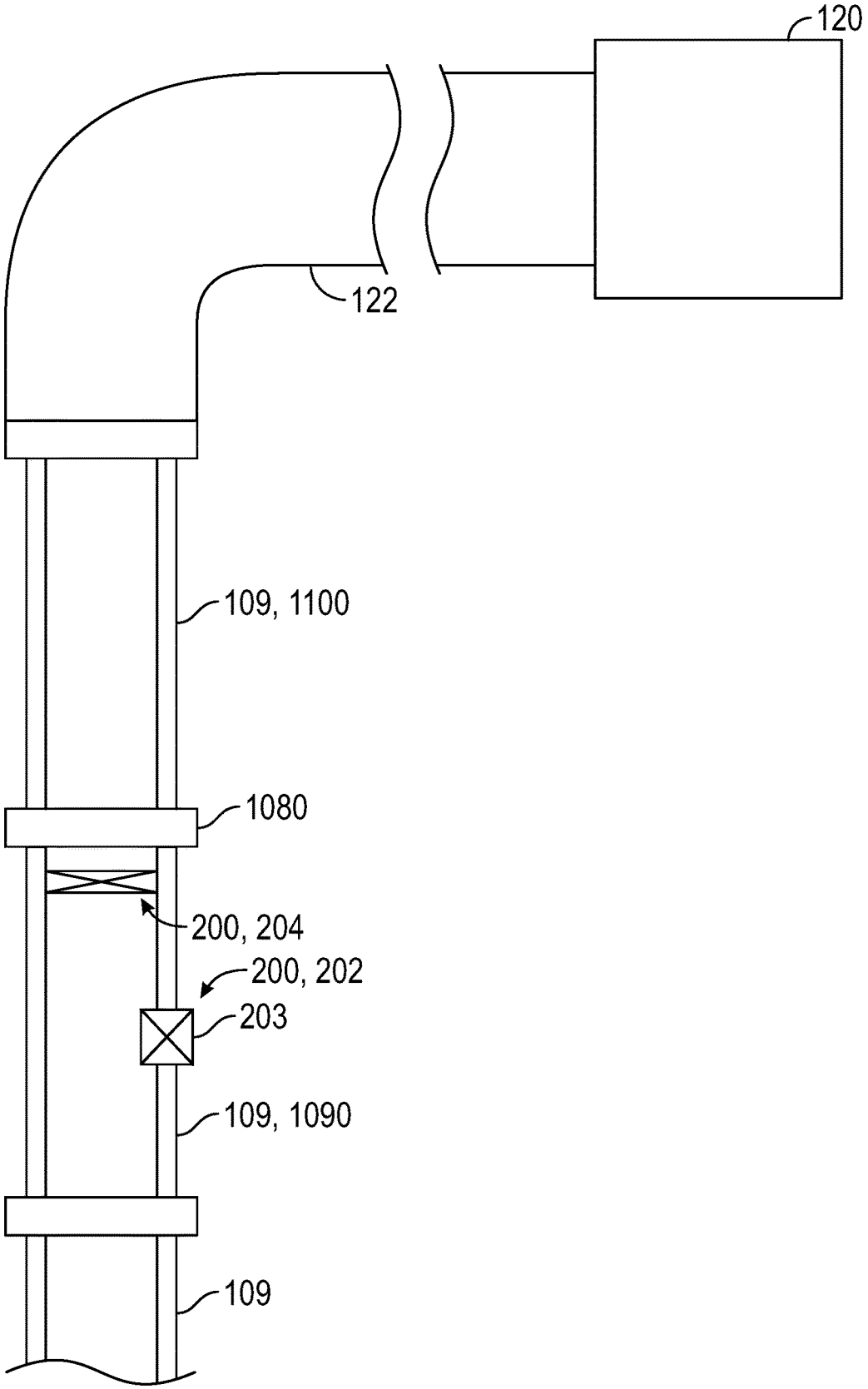
FIG. 2C is a diagram illustrating the hydraulic work over unit of FIG. 2A where a new drill collar has been coupled to the drill string.

In some embodiments, such as discussed further in FIGS. 2A-C, the pump 120 can circulate the drilling fluid through a side supply conduit 206 to a continuous circulation component 200, through the interior of drill string 108, through orifices in drill bit 114, back to the surface via the annulus around drill string 108, and into a retention pit 124. The continuous circulation component 200 can be operable to provide continuous circulation of the drilling fluid while a new drill collar 109 is being coupled to the drill string 108 and the insertion component 57 is disconnected. The continuous circulation component 200 can substantially maintain a wellbore density at a predetermined density such that the wellbore 116 is underbalanced. Since the circulation is not interrupted, the same balance can be maintained between the drilling fluid, the added gas, and the formation contribution. In conventional drilling systems where the flow is interrupted to add a new collar, a significant pressure increase is required to resume the circulation to put back all the fluids in motion. With a continuous circulation component 200, there is no such pressure bump.

As illustrated in FIGS. 1A and 1B, sensors 126 can be provided, for example integrated into the bottom-hole assembly 125 near the drill bit 114. As the drill bit 114 extends the wellbore 116 through the formations 118, the sensors 126 can collect measurements of various drilling parameters, for example relating to various formation properties, the orientation of the drilling component(s) 101, dog leg severity, pressure, temperature, weight on bit, torque on bit, and/or rotations per minute. The sensors 126 can be any suitable sensor to measure the drilling parameters, for example transducers, fiber optic sensors, and/or surface and/or downhole sensors. The bottom-hole assembly 125 may also include a telemetry sub 128 of a telemetry component 130 to transfer measurement data to controller 300 through a surface transceiver 129 of the telemetry component 130 and to receive commands from the surface.

In some examples, the telemetry component 130 communicates using electromagnetic telemetry, acoustic telemetry, mud pulse telemetry, and/or wired telemetry. The telemetry utilized is dependent on the wellbore 116 and the details of the drilling process such as the drilling fluid. For example, if the drilling fluid includes gas, mud pulse telemetry may not be functional, and electromagnetic telemetry and/or acoustic telemetry may be utilized. Electromagnetic telemetry can establish a two-way communications link between the surface and the bottomhole assembly 125. Using low-frequency electromagnetic wave propagation, electromagnetic telemetry can facilitate high-speed data transmission to and from the surface through any formation 118. Data formats can be readily customized to suit the drilling needs of the particular wellbore 116. Acoustic telemetry may utilize longitudinal and/or torsional wave transmission. If two phases such as air and liquid are not present such that the drilling fluid is one phase, mud pulse telemetry may be utilized.

In some embodiments, the telemetry component 130 may utilize wired telemetry where each of the sensors 126 may include a plurality of tool components, spaced apart from each other, and communicatively coupled with one or more wires. In some examples, the telemetry component 130 may include wireless telemetry or logging capabilities, or both, such as to transmit information in real time indicative of actual downhole drilling parameters to operators on the surface.

In other examples, the telemetry sub 128 does not communicate with the surface, but rather stores logging data for later retrieval at the surface when the logging assembly is recovered. Notably, one or more of the bottom-hole assembly 125, the sensors 126, and the telemetry sub 128 may also operate using a non-conductive cable (e.g. slickline, etc.) with a local power supply, such as batteries and the like. When employing non-conductive cable, communication may be supported using, for example, wireless protocols (e.g. EM, acoustic, etc.) and/or measurements and logging data may be stored in local memory for subsequent retrieval at the surface.

The sensors 126, for example an acoustic logging tool, may also include one or more computing devices 150 communicatively coupled with one or more of the plurality of drilling components 101. The computing device 150 may be configured to control or monitor the performance of the sensors 126, process logging data, and/or carry out the methods of the present disclosure.

In at least some cases, one or more of the sensors 126 may receive electrical power from a wire that extends to the surface, including wires extending through a wired drill string 108. In at least some examples the methods and techniques of the present disclosure may be performed by a controller 300, for example a computing device, on the surface. The controller 300 is discussed in further detail below in FIG. 3. In some examples, the controller 300 may be included in and/or communicatively coupled with surface receiver 129. For example, surface receiver 129 of wellbore operating environment 10 at the surface may include one or more of wireless telemetry, processor circuitry, or memory facilities, such as to support substantially real-time processing of data received from one or more of the sensors 126. In some examples, data can be processed at some time subsequent to its collection, wherein the data may be stored on the surface at surface receiver 129, stored downhole in telemetry sub 128, or both, until it is retrieved for processing.

FIGS. 2A-2C illustrate the continuous circulation component 200 maintaining circulation of the drilling fluid while a new drill collar 1100 is coupled to the drill string 108. As illustrated in FIG. 2A, an upper supply conduit 122 is coupled with an upper end 1080 of a top drill collar 1090 of the drill string 108. The upper supply conduit 122 is coupled with the pump 120 to pump the drilling fluid into the channel 160 of the drill string 108. The channel 160 of the drill string 108 permits the drilling fluid to pass to the bottomhole assembly 125 in the wellbore 116.

The top drill collar 1090 includes the continuous circulation component 200. While FIGS. 2A-2C illustrate only the top drill collar 1090 including the continuous circulation component 200, any and/or all of the drill collars 109 can include the continuous circulation component 200 such that continuous circulation of the drilling fluid is maintained while adding new drill collars 1100. The continuous circulation component 200 includes a side port 202 extending from a wall of the top drill collar 1090. The side port 202 provides fluidic communication with the channel 106 such that the drilling fluid can be pumped into the channel through the side port 202 while the new drill collar 1100 (as shown in FIGS. 2B and 2C) is coupled to the drill string. The side port 202 includes a side valve 203 which can be opened to permit drilling fluid to pass into the channel 106 and closed to prevent drilling fluid from passing through the side port 202 when undesired. For example, in FIG. 2A, the upper supply conduit 122 is still coupled with the top drill collar 1090 and is supplying drilling fluid into the channel 106 through the upper end 1080 of the top drill collar 1090. The side valve 203 is closed to prevent the drilling fluid from passing through the side port 202.

Similarly, the top drill collar 1090 includes an upper valve 204 which extends across the channel 160 above the side port 202 in that the upper valve 204 is closer to the upper end 1080 of the top drill collar 1090. The upper valve 204 is operable to be opened when the drilling fluid is being pumped into the channel 160 through the upper end 1080 of the top drill collar 1090 by the upper supply conduit 122.

As illustrated in FIG. 2B, when a new drill collar 1100 is coupled to the drill string 108, the upper supply conduit 122 is disconnected and the new drill collar is coupled to the upper end 1080 of the top drill collar 1090 of the drill string 108. However, to maintain continuous circulation, a side supply conduit 206 is connected to the side port 202, and the pump 120 pumps the drilling fluid through the side supply conduit 206. The side valve 203 is opened to permit the drilling fluid to pass through the side port 202 into the channel 160. The upper valve 204 is closed to prevent the drilling fluid from flowing up the channel 160 out of the upper end 1080 of the top drill collar 1090 so that the drilling fluid flows down the channel 160 to the bottomhole assembly 125. The continuous circulation component 200 maintains the injection of drilling fluid while the upper supply conduit 122 is disconnected to couple the new drill collar 1100 to the drill string 108.

FIG. 2C illustrates the new drill collar 1100 coupled with the drill string 108, and the upper supply conduit 122 coupled with the new drill collar 1100. As the drilling fluid is pumped through the upper supply conduit 122 into the channel 160 of the drill string 108, the side valve 203 of the side port 202 is closed, the upper valve 204 is opened, and the side supply conduit 206 is disconnected. Accordingly, the new drill collar 1100 has been added to the drill string 108, and the drilling fluid was continuously circulated so that the density of the wellbore 116 is maintained at the predetermined level for underbalanced drilling.

Figure 3:
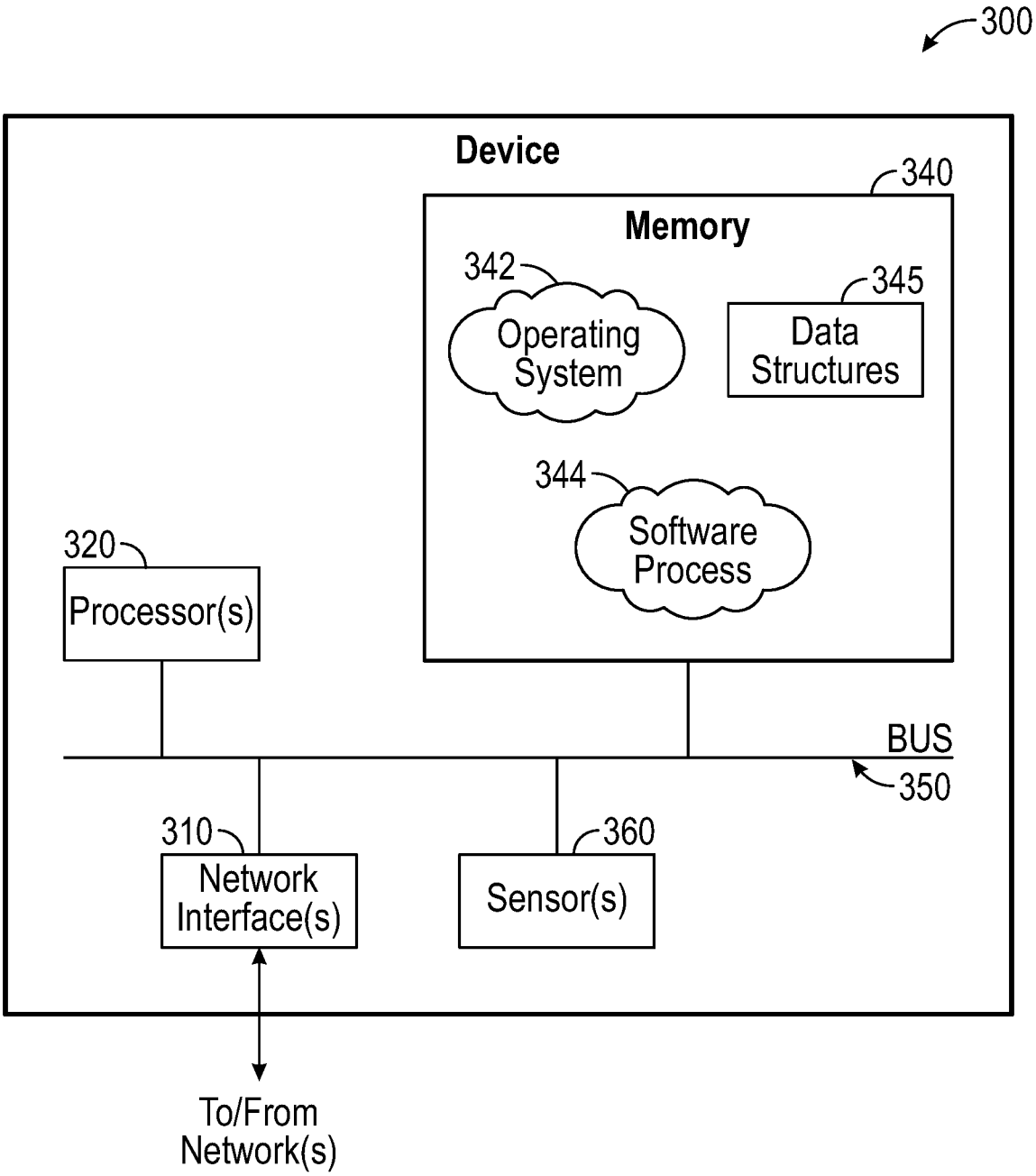
FIG. 3 is a diagram of a controller which may be employed as shown in FIG. 1.

FIG. 3 is a block diagram of an exemplary controller 300. Controller 300 is configured to perform processing of data and communicate with the drilling components 101, for example as illustrated in FIGS. 1-2C. In operation, controller 300 communicates with one or more of the above-discussed components and may also be configured to communication with remote devices/systems.

As shown, controller 300 includes hardware and software components such as network interfaces 310, at least one processor 320, sensors 360 and a memory 340 interconnected by a system bus 350. Network interface(s) 310 can include mechanical, electrical, and signaling circuitry for communicating data over communication links, which may include wired or wireless communication links. Network interfaces 310 are configured to transmit and/or receive data using a variety of different communication protocols.

Processor 320 represents a digital signal processor (e.g., a microprocessor, a microcontroller, or a fixed-logic processor, etc.) configured to execute instructions or logic to perform tasks in a wellbore environment. Processor 320 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 320 typically operates in conjunction with shared or dedicated hardware, including but not limited to, hardware capable of executing software and hardware. For example, processor 320 may include elements or logic adapted to execute software programs and manipulate data structures 345, which may reside in memory 340.

Sensors 360 typically operate in conjunction with processor 320 to perform measurements, and can include special-purpose processors, detectors, transmitters, receivers, and the like. In this fashion, sensors 360 may include hardware/software for generating, transmitting, receiving, detection, logging, and/or sampling magnetic fields, seismic activity, and/or acoustic waves, temperature, pressure, or other parameters.

Memory 340 comprises a plurality of storage locations that are addressable by processor 320 for storing software programs and data structures 345 associated with the embodiments described herein. An operating system 342, portions of which may be typically resident in memory 340 and executed by processor 320, functionally organizes the device by, inter alia, invoking operations in support of software processes and/or services 344 executing on controller 300. These software processes and/or services 344 may perform processing of data and communication with controller 300, as described herein. Note that while process/service 344 is shown in centralized memory 340, some examples provide for these processes/services to be operated in a distributed computing network.

Other processor and memory types, including various computer-readable media, may be used to store and execute program instructions pertaining to the fluidic channel evaluation techniques described herein. Also, while the description illustrates various processes, it is expressly contemplated that various processes may be embodied as modules having portions of the process/service 344 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 320 or computer readable medium encoded with instructions for execution by processor 320 that, when executed by the processor, are operable to cause the processor to perform the functions described herein.

Figure 4:
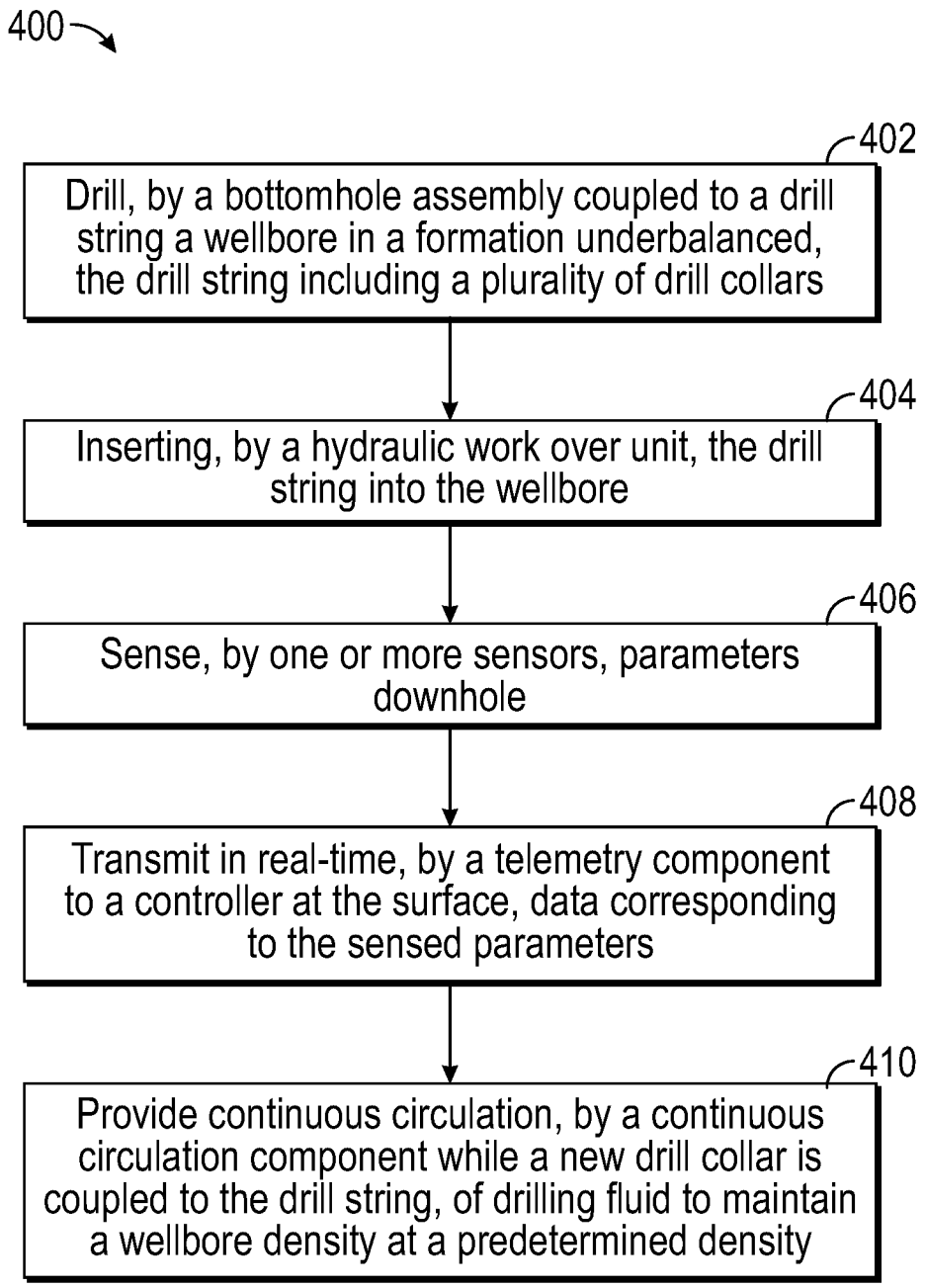
FIG. 4 is a flow chart illustrating an example of a drilling system that may be used in accordance with the present disclosure.

Referring to FIG. 4, a flowchart is presented in accordance with an example embodiment. The method 400 is provided by way of example, as there are a variety of ways to carry out the method. The method 400 described below can be carried out using the configurations illustrated in FIGS. 1-3, for example, and various elements of these figures are referenced in explaining example method 400. Each block shown in FIG. 4 represents one or more processes, methods or subroutines, carried out in the example method 400. Furthermore, the illustrated order of blocks is illustrative only and the order of the blocks can change according to the present disclosure. Additional blocks may be added or fewer blocks may be utilized, without departing from this disclosure. The example method 400 can begin at block 402.

At block 402, a bottomhole assembly coupled to a drill string drills a wellbore in a formation underbalanced. The drill string includes a plurality of drill collars such that the diameter of the drill string and wellbore is larger than with coiled tubing.

At block 404, a hydraulic workover unit inserts the drill string into the wellbore. The hydraulic work over unit is operable to rotate and/or lower the drill string into the wellbore with an insertion component. In some embodiments, for example when using a stand alone hydraulic work over unit, the insertion component can include a rotary table. In some embodiments, for example when using a rig as in FIG. 1B, the insertion component can include a top drive. Accordingly, in some examples, the drill string with the plurality of drill collars can be maneuvered and directed through wellbores with long laterals. A pump is operable to pump drilling fluid into a channel of the drill string through an upper supply conduit coupled with an upper end of a top drill collar of the drill string.

At block 406, one or more sensors sense parameters downhole. At block 408, a telemetry component transmits data corresponding to the sensed parameters in real-time to a controller at the surface. Depending on the wellbore and the drilling fluid, the signal transmitted by the telemetry component is transmitted by one or more of the following: electromagnetic telemetry, acoustic telemetry, mud pulse telemetry, and/or wired telemetry.

At block 410, a continuous circulation component provides continuous circulation of the drilling fluid while a new drill collar is coupled to the drill string to maintain a wellbore density at a predetermined density. To couple the new drill collar to the drill string, the upper supply conduit is disconnected, and the new drill collar is coupled to the top drill collar of the drill string. However, to maintain continuous circulation of the drilling fluid, a side supply conduit is coupled with a side port extending from a wall of the top drill collar. The pump, while the upper supply conduit is disconnected, pumps the drilling fluid into the channel of the drill string through the side port. Additionally, to prevent the drilling fluid being pumped through the side port from flowing out of the upper end of the top drill collar while the upper supply conduit is disconnected, an upper valve in the top drill collar is closed. The upper valve is disposed in the channel above the side port. In other words, the upper valve is in the channel and closer to the upper end of the top drill collar than the side port.

Numerous examples are provided herein to enhance understanding of the present disclosure. A specific set of statements are provided as follows.

Statement 1: An underbalanced drilling system is disclosed comprising: a bottomhole assembly including a drill bit, the bottomhole assembly operable to conduct drilling of an underbalanced wellbore in a formation from a surface, the bottomhole assembly including a telemetry sub; a telemetry component operable to transmit signals in real-time between the telemetry sub of the bottomhole assembly and a controller on the surface; a drill string coupled to the bottomhole assembly, the drill string including a plurality of drill collars, the plurality of drill collars forming a channel operable to permit drilling fluid to flow from the surface to the bottomhole assembly, the drill string operable to be inserted into the wellbore by a hydraulic work over unit; and a continuous circulation component operable to provide continuous circulation of the drilling fluid while a new drilling collar is coupled to the drill string, the continuous circulation component operable to substantially maintain a wellbore density at a predetermined density.

Statement 2: An underbalanced drilling system as disclosed in Statement 1, further comprising an upper supply conduit coupled with an upper end of the top drill collar of the drill string, the upper supply conduit coupled with a pump to pump the drilling fluid into the channel of the drill string.

Statement 3: An underbalanced drilling system as disclosed in Statement 2, wherein the new drill collar is coupled to the upper end of the top drill collar of the drill string.

Statement 4: An underbalanced drilling system as disclosed in Statement 3, wherein the continuous circulation component includes a side port extending from a wall of the top drill collar, the side port providing fluidic communication with the channel such that the drilling fluid is pumped into the channel through the side port while the new drill collar is coupled to the drill string.

Statement 5: An underbalanced drilling system as disclosed in Statement 4, wherein the top drill collar includes an upper valve operable to close when the new drill collar is coupled to the drill string to prevent the drilling fluid from the side port from flowing out of the upper end of the top drill collar.

Statement 6: An underbalanced drilling system as disclosed in any of preceding Statements 1-5, wherein the hydraulic work over unit includes an insertion component coupled with the drill string, the insertion component being operable to rotate the drill string and/or lower the drill string into the wellbore.

Statement 7: An underbalanced drilling system as disclosed in any of preceding Statements 1-6, wherein the signal transmitted by the telemetry component is transmitted by one or more of the following: electromagnetic telemetry, acoustic telemetry, mud pulse telemetry, and/or wired telementry.

Statement 8: A system to drill an underbalanced wellbore comprising: a bottomhole assembly including a drill bit, the bottomhole assembly operable to conduct drilling of an underbalanced wellbore in a formation from a surface, the bottomhole assembly including a telemetry sub; a telemetry sub component operable to transmit signals in real-time between the telemetry sub of the bottomhole assembly and a controller on the surface; a drill string coupled to the bottomhole assembly the drill string including a plurality of drill collars, the plurality of drill collars forming a channel operable to permit drilling fluid to flow from the surface to the bottomhole assembly, the drill string being inserted into the wellbore by a hydraulic work over unit; and a continuous circulation component operable to provide continuous circulation of the drilling fluid while a new drill collar is coupled to the drill string, the continuous circulation component operable to substantially maintain a wellbore density at a predetermined density.

Statement 9: A system as disclosed in Statement 8, further comprising an upper supply conduit coupled with an upper end of the top drill collar of the drill string, the upper supply conduit coupled with a pump to pump the drilling fluid into the channel of the drill string.

Statement 10: A system as disclosed in Statement 9, wherein the new drill collar is coupled to the upper end of the top drill collar of the drill string.

Statement 11: A system as disclosed in Statement 10, wherein the continuous circulation component includes a side port extending from a wall of the top drill collar, the side port providing fluidic communication with the channel such that the drilling fluid is pumped into the channel through the side port while the new drill collar is coupled to the drill string.

Statement 12: A system as disclosed in Statement 11, wherein the top drill collar includes an upper valve operable to close when the new drill collar is coupled to the drill string to prevent the drilling fluid from the side port from flowing out of the upper end of the top drill collar.

Statement 13: A system as disclosed in any of preceding Statements 8-12, wherein the hydraulic work over unit includes an insertion component coupled with the drill string, the insertion component being operable to rotate the drill string and/or lower the drill string into the wellbore.

Statement 14: A system as disclosed in any of preceding Statements 8-13, wherein the signal transmitted by the telemetry component is transmitted by one or more of the following: electromagnetic telemetry, acoustic telemetry, mud pulse telemetry, and/or wired telemetry.

Statement 15: A method comprising: drilling, by a bottomhole assembly coupled to a drill string, an underbalanced wellbore in a formation, the drill string including a plurality of drill collars; inserting, by a hydraulic work over unit, the drill string into the wellbore; sensing, by one or more sensors, parameters downhole; transmitting in real-time, by a telemetry component to a controller at the surface, data corresponding to the sensed parameters; and providing continuous circulation, by a continuous circulation component while a new drill collar is coupled to the drill string, of drilling fluid to maintain a wellbore density at a predetermined density.

Statement 16: A method as disclosed in Statement 15, further comprising: pumping, by a pump, the drilling fluid into a channel of the drill string through an upper supply conduit coupled with an upper end of a top drill collar of the drill string.

Statement 17: A method as disclosed in Statement 16, wherein providing continuous circulation comprises: disconnecting the upper supply conduit; coupling the new drill collar to a top drill collar of the drill string.

Statement 18: A method as disclosed in Statement 17, wherein providing continuous circulation further comprises: pumping, by the pump while the upper supply conduit is disconnected, the drilling fluid into the channel of the drill string through a side port extending from a wall of the top drill collar.

Statement 19: A method as disclosed in Statement 18, wherein providing continuous circulation further comprises: closing an upper valve in the top drill collar to prevent the drilling fluid being pumped through the side port from flowing out of the upper end of the top drill collar while the upper supply conduit is disconnected.

Statement 20: A method as disclosed in any of preceding Statements 15-19, further comprising: rotating and/or lowering the drill string into the wellbore with an insertion component of the hydraulic work over unit.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. An underbalanced drilling system comprising:

a bottomhole assembly including a drill bit, the bottomhole assembly operable to conduct drilling of an underbalanced wellbore in a formation from a surface, the bottomhole assembly including a telemetry sub;

a telemetry component using electromagnetic telemetry, acoustic telemetry, or wired telemetry operable to transmit signals in real-time between the telemetry sub of the bottomhole assembly and a controller on the surface;

a drill string coupled to the bottomhole assembly, the drill string including a plurality of drill collars, the plurality of drill collars forming a channel operable to permit drilling fluid to flow from the surface to the bottomhole assembly, the drill string operable to be inserted into the wellbore by a hydraulic work over unit;

the hydraulic work over unit operable to raise, lower, manipulate and steer the drill string to accommodate laterals in the wellbore and to raise and lower one or more drilling components into the wellbore; and a continuous circulation component operable to provide continuous circulation of the drilling fluid while a new drill collar is coupled to the drill string, the continuous circulation component operable to substantially maintain a wellbore density at a predetermined density and a wellbore pressure lower than the formation pressure.

2. The underbalanced drilling system of claim 1, further comprising an upper supply conduit coupled with an upper end of a top drill collar of the drill string, the upper supply conduit coupled with a pump to pump the drilling fluid into the channel of the drill string.

3. The underbalanced drilling system of claim 2, wherein the new drill collar is coupled to the upper end of the top drill collar of the drill string.

4. The underbalanced drilling system of claim 3, wherein the continuous circulation component includes a side port extending from a wall of the top drill collar, the side port providing fluidic communication with the channel such that the drilling fluid is pumped into the channel through the side port while the new drill collar is coupled to the drill string.

5. The underbalanced drilling system of claim 4, wherein the top drill collar includes an upper valve operable to close when the new drill collar is coupled to the drill string to prevent the drilling fluid from the side port from flowing out of the upper end of the top drill collar.

6. The underbalanced drilling system of claim 1, wherein the hydraulic work over unit includes an insertion component coupled with the drill string, the insertion component being operable to rotate the drill string and/or lower the drill string into the wellbore.

7. The underbalanced drilling system of claim 1, wherein the signal transmitted by the telemetry component is transmitted by one or more of the following: electromagnetic telemetry, acoustic telemetry, mud pulse telemetry, wired telemetry.

8. A system to drill an underbalanced wellbore comprising:

a bottomhole assembly including a drill bit, the bottomhole assembly operable to conduct drilling of an underbalanced wellbore in a formation from a surface, the bottomhole assembly including a telemetry sub;

a telemetry component using electromagnetic telemetry, acoustic telemetry, or wired telemetry operable to transmit signals in real-time between the telemetry sub of the bottomhole assembly and a controller on the surface;

a drill string coupled to the bottomhole assembly, the drill string including a plurality of drill collars, the plurality of drill collars forming a channel operable to permit drilling fluid to flow from the surface to the bottomhole assembly, the drill string operable to be inserted into the wellbore by a hydraulic work over unit;

the hydraulic work over unit operable to raise, lower, manipulate and steer the drill string to accommodate laterals in the wellbore and to raise and lower one or more drilling components into the wellbore; and a continuous circulation component operable to provide continuous circulation of the drilling fluid while a new drill collar is coupled to the drill string, the continuous circulation component operable to substantially maintain a wellbore density at a predetermined density and a wellbore pressure lower than the formation pressure.

9. The system of claim 8, further comprising an upper supply conduit coupled with an upper end of the top drill collar of a top drill collar, the upper supply conduit coupled with a pump to pump the drilling fluid into the channel of the drill string.

10. The system of claim 9, wherein the new drill collar is coupled to the upper end of the top drill collar of the drill string.

11. The system of claim 10, wherein the continuous circulation component includes a side port extending from a wall of the top drill collar, the side port providing fluidic communication with the channel such that the drilling fluid is pumped into the channel through the side port while the new drill collar is coupled to the drill string.

12. The system of claim 11, wherein the top drill collar includes an upper valve operable to close when the new drill collar is coupled to the drill string to prevent the drilling fluid from the side port from flowing out of the upper end of the top drill collar.

13. The system of claim 8, wherein the hydraulic work over unit includes an insertion component coupled with the drill string, the insertion component being operable to rotate the drill string and/or lower the drill string into the wellbore.

14. The system of claim 8, wherein the signal transmitted by the telemetry component is transmitted by one or more of the following: electromagnetic telemetry, acoustic telemetry, mud pulse telemetry, and/or wired telemetry.

15. A method comprising:

drilling, by a bottomhole assembly coupled to a drill string, an underbalanced wellbore in a formation, the drill string including a plurality of drill collars;

inserting, by a hydraulic work over unit, the drill string and one or more components into the wellbore;

the hydraulic work over unit operable to raise, lower, manipulate and steer the drill string to accommodate laterals in the wellbore and to raise and lower one or more drilling components into the wellbore;

sensing, by one or more sensors, parameters downhole;

transmitting in real-time, by a telemetry component using electromagnetic telemetry, acoustic telemetry, or wired telemetry to a controller at a surface, data corresponding to the sensed parameters; and providing continuous circulation, by a continuous circulation component while a new drill collar is coupled to the drill string, of drilling fluid to maintain a wellbore density at a predetermined density and a wellbore pressure lower than the formation pressure.

16. The method of claim 15, further comprising:

pumping, by a pump, the drilling fluid into a channel of the drill string through an upper supply conduit coupled with an upper end of a top drill collar of the drill string.

17. The method of claim 16, wherein providing continuous circulation comprises:

disconnecting the upper supply conduit;

coupling the new drill collar to the top drill collar of the drill string.

18. The method of claim 17, wherein providing continuous circulation further comprises:

pumping, by the pump while the upper supply conduit is disconnected, the drilling fluid into the channel of the drill string through a side port extending from a wall of the top drill collar.

19. The method of claim 18, wherein providing continuous circulation further comprises:

closing an upper valve in the top drill collar to prevent the drilling fluid being pumped through the side port from flowing out of the upper end of the top drill collar while the upper supply conduit is disconnected.

20. The method of claim 15, further comprising:

rotating and/or lowering the drill string into the wellbore with an insertion component of the hydraulic work over unit.

* * * * *